US006184802B1

(12) United States Patent
Lamb

(10) Patent No.: US 6,184,802 B1
(45) Date of Patent: Feb. 6, 2001

(54) AUTONOMOUS ESTIMATOR OF VEHICLE ARRIVAL TIME

(76) Inventor: Robert Goodman Lamb, 3121 U.S. Hwy. 64, Apex, NC (US) 27502

( * ) Notice: Under 35 U.S.C. 154(b), the term of this patent shall be extended for 0 days.

(21) Appl. No.: 09/417,385

(22) Filed: Oct. 13, 1999

Related U.S. Application Data

(60) Provisional application No. 60/103,986, filed on Oct. 13, 1998.

(51) Int. Cl.[7] ..... G08G 1/095

(52) U.S. Cl. ..... 340/994; 340/988; 340/989; 340/992

(58) Field of Search ..... 340/994, 995, 340/988, 989, 992

(56) References Cited

U.S. PATENT DOCUMENTS

| | | | | |
|---|---|---|---|---|
| 5,483,234 | * | 1/1996 | Carreel et al. | 340/994 |
| 5,493,295 | * | 2/1996 | Lewiner et al. | 340/994 |
| 5,570,100 | | 10/1996 | Grube et al. . | |
| 5,661,652 | * | 8/1997 | Sprague et al. | 455/456 |
| 5,736,940 | * | 4/1998 | Burgener | 340/994 |
| 5,919,239 | * | 7/1999 | Fraker et al. | 340/573.1 |
| 6,006,159 | * | 12/1999 | Schmier et al. | 340/994 |
| 6,023,652 | * | 2/2000 | Arakawa et al. | 340/995 |

FOREIGN PATENT DOCUMENTS

| | | | | |
|---|---|---|---|---|
| 4-80898 | * | 3/1992 | (JP) | C08G/1/127 |
| 5-174295 | * | 7/1993 | (JP) | G08G/1/127 |

* cited by examiner

*Primary Examiner*—Daniel J. Wu
*Assistant Examiner*—Son Tang

(57) ABSTRACT

An autonomous apparatus for generating real-time estimates of the time of arrival of vehicles at user selected sites. The apparatus is comprised of two separate components, a vehicle unit which is carried by each vehicle and a user unit which is carried by each user. The vehicle unit determines time and geographical position at predetermined locations and broadcast these data to the user units through a wireless communications medium. The user unit receives the time and position information and adds it to computer memory records of similar data received over a prior period of time. The combined set of recorded data is used to estimate the time that the broadcasting vehicle will arrive at a specific location, that location having been specified by the user on a previous occasion by pressing a button on the user unit when the vehicle was stopped at the selected location. The estimated arrival time is presented on a display. The system operates without any assistance or information input from humans and its user require no special knowledge or skills. It is ideally suited for application to school bus transportation services.

3 Claims, 7 Drawing Sheets

AUTONOMOUS ESTIMATOR OF VEHICLE ARRIVAL TIME

CROSS-REFERENCE TO RELATED APPLICATION

This application claims the benefit of Provisional Patent Application Ser. No. 60/103,986 filed Oct. 13, 1998.

BACKGROUND

1. Field of Invention

This invention relates to communication and transportation systems, specifically to a system for informing the users of surface transportation facilities when the next vehicle will arrive at their boarding site.

2. Discussion of Prior Art

This invention is designed to help people use surface transportation facilities, particularly those that offer only infrequent service and that are unable, for reasons inherent to the nature of the system, to adhere closely to fixed time schedules. Facilities with these deficiencies can be a burden to use for anyone who must rely on them as their sole or primary means of transportation.

A prime example is the school bus transportation system. In most locations it provides only one pickup in the morning and only one dropoff in the afternoon. With only one opportunity for a ride available, the student must make special efforts to avoid missing the bus. These efforts are exacerbated when the bus deviates significantly from its nominal time schedule. In the case of school busses, large fluctuations in the arrival time are not uncommon due in part to the special situations with which the drivers must contend. These include delays loading students, especially young ones; waiting for students that are late arriving at the stop; stops to deal with discipline or emergency problems on the bus; mechanical malfunctions; etc. Add to these the normal delays to be expected from traffic congestion, train crossings, weather, etc. and it is not surprising that variations of one-half hour in the arrival time of the bus at any given loading point are not uncommon.

Dealing with these two shortcomings, namely the single pickup and the fluctuating schedule, poses a difficult problem because attempts to minimize the adverse effects of the one shortcoming maximize the penalty imposed by the other. For example, if the student attempts to minimize the risk of missing the bus by arriving at the loading site at the earliest time that the bus is likely to arrive, over the long run he or she maximizes not only the idle waiting time, but also the exposure to harsh weather and exposure to potentially dangerous motor vehicle traffic at the bus stop. This problem plagues the user of any transportation system that provides infrequent service on an erratic schedule.

According to School Transportation News (1997, www.stnonline.com), school transportation provides approximately 10 billion student rides annually, making it the largest public transportation system in the United States. In view of this, it is surprising that there is no prior art addressing the problems just cited.

Within the last few years several patents have been issued for systems that advise transit users of vehicle arrival times. These include Schmier et al. (U.S. Pat. No. 6,006,159), Burgener (U.S. Pat. No. 5,736,940), and Lewiner et al (U.S. Pat. No. 5,493,295). However, none of these is well suited for application to the school bus transportation system because each requires that the locations of all stops be predetermined and that each stop have a name or identifying number. School bus stops are generally not prespecified and they do not have names or numbers. A stop can be any point where a driveway meets a highway and new stops can be created and old ones abandoned from one day to the next as the need changes. The system disclosed herein allows the user to designate a stop simply by pressing a button on a user device at any time that the transport vehicle is actually stopped at the desired location. The arrival time displayed by the user device is the arrival time for that site until the button is pressed to designate a different boarding location. Another deficiency of the prior art inventions cited above is that each requires an elaborate data base of route information, stop locations and names, travel times between stops, and the like. Collecting all this information and keeping it updated in the system would require a full-time staff. The system disclosed here requires no information that the system cannot gather itself and thus it is capable of operating without human intervention. This feature makes it much more economical to deploy and maintain than any system now available.

OBJECTS AND ADVANTAGES

It is a primary objective of this invention to provide users of surface transportation systems with a novel means of determining with an accuracy of the order of one minute the actual time that the transport vehicle will arrive at their boarding site on any chosen occasion. Additional objectives are (1) that the arrival time estimations are made completely autonomously, that is, without the need of any human intervention;

(2) that the device that provides the arrival time estimation does not require any special skills or extensive training to operate;

(3) that the cost of using the arrival time estimator is within the reach of a vast majority of people who use public transportation.

This invention offers a number of advantages. First, the users of the transportation facility benefit because by knowing when a vehicle will actually arrive, the user can minimize the time that he or she spends waiting at the boarding site. This in turn minimizes wasted time, exposure to harsh weather, safety hazards posed by vehicular traffic at the boarding site, vulnerability to crime, etc. Secondly, the transportation facility itself benefits because this invention makes the service less cumbersome to use and hence it can increase patronage. The transportation facility would benefit further if this invention were available to all its users, because in that case the facility could maximize its efficiency by operating on a flexible rather than a rigid schedule. Under the latter, transport vehicles often have mandatory stops at intermediate points along their routes to prevent them from running ahead of schedule when travel conditions are more favorable than normal. This invention would preclude the need for fixed schedules allowing each transport vehicle to move as quickly along its route as conditions permitted.

While the main objective of the present invention is to assist people in their use of transportation facilities, other services could be provided as well. For example, it could be used to estimate the arrival time of mail or parcel delivery vehicles. This service would be particularly useful in rural areas where mail is generally not delivered to the house and where delivery times can vary by more than an hour from one day to the next.

Another feasible application of this invention would be within community emergency warning broadcast networks.

Currently, severe weather warnings of tornados and severe thunderstorms are broadcast over areas much larger than the area that is actually at risk. As a result, for most of the recipients of the broadcast the warning is a false alarm. Over time this erodes the credibility and hence the usefulness of the warning service. However, the present invention provides a remedy to this situation because in the process of estimating vehicle arrival time it determines the geographical coordinates of a site, which would generally be a point near the user's home or office. Having this information and having the warning network broadcast an explicit, quantitative definition of the area at risk, this invention could provide a means of delivering warnings only to those people who are actually in danger.

SUMMARY

This invention describes a system, referred to hereinafter as the autonomous estimator, that informs users of surface transportation facilities of the time that a transport vehicle will actually arrive at their specific boarding site. The autonomous estimator requires that each vehicle carry a "vehicle unit" and that each user have access to a "user unit".

Each vehicle unit is comprised of a means for determining time and spatial location, such as a Global Positioning Satellite (GPS) unit; a microprocessor device; and a radio transmitter. Each user unit is comprised of a radio receiver, a microprocessor device, and a display.

As the vehicle moves along its route, the vehicle unit's microprocessor collects from the time and location determining unit the spatial location S and the corresponding time T at each point where the vehicle stops and at predetermined intervals between widely separated stops. These [S,T] data, hereinafter referred to as space-time coordinates, are subsequently broadcast over the vehicle unit's radio transmitter.

The user unit receives the [S,T] data and stores them in its memory. These data are recorded in a circular buffer that is large enough to hold data from at least one complete traversal of the vehicle's route.

The user specifies a boarding site by pressing a button on the user unit any time the vehicle is stopped at a desired boarding location. The microprocessor notes the time $T_B$ that the button was pressed. It then scans the circular buffer for the member [S,T] whose time component T is equal to $T_B$. The spatial component S of that member is then recorded as the boarding site location $S_B$.

The user unit uses the last received vehicle location [S,T], the circular buffer of [S,T] data, and the boarding site coordinates $S_B$ to estimate the time of arrival. The arrival time estimate is shown on a display on the user unit.

DESCRIPTION OF INVENTION

The autonomous estimator consists of two separate components: a vehicle unit and a user unit. A vehicle unit is carried by each transportation facility vehicle as it travels along its scheduled route. A user unit is carried by, or is accessible to, each vehicle user.

In general, the apparatus of the invention for estimating the time of arrival of vehicles at specific boarding sites comprises: a vehicle unit which is carried by each transportation vehicle, and a user unit which is available to each user; the vehicle unit comprising a means for determining space-time coordinates of the vehicle unit's location; a means for collecting and recording the space-time coordinates that satisfy a set of predetermined criteria; a means for broadcasting space-time coordinates and other related information; a user unit comprising a means for receiving space-time coordinates and other related information broadcast by the vehicle unit; a means for generating a database of space-time coordinates from the space-time coordinates received; a means for specifying from the database of space-time coordinates the spatial coordinates of a user selected site; a means for estimating from the database of space-time coordinates the time of arrival at the user selected site of the vehicle carrying the vehicle unit; a means for displaying the time of arrival.

Figure 1:
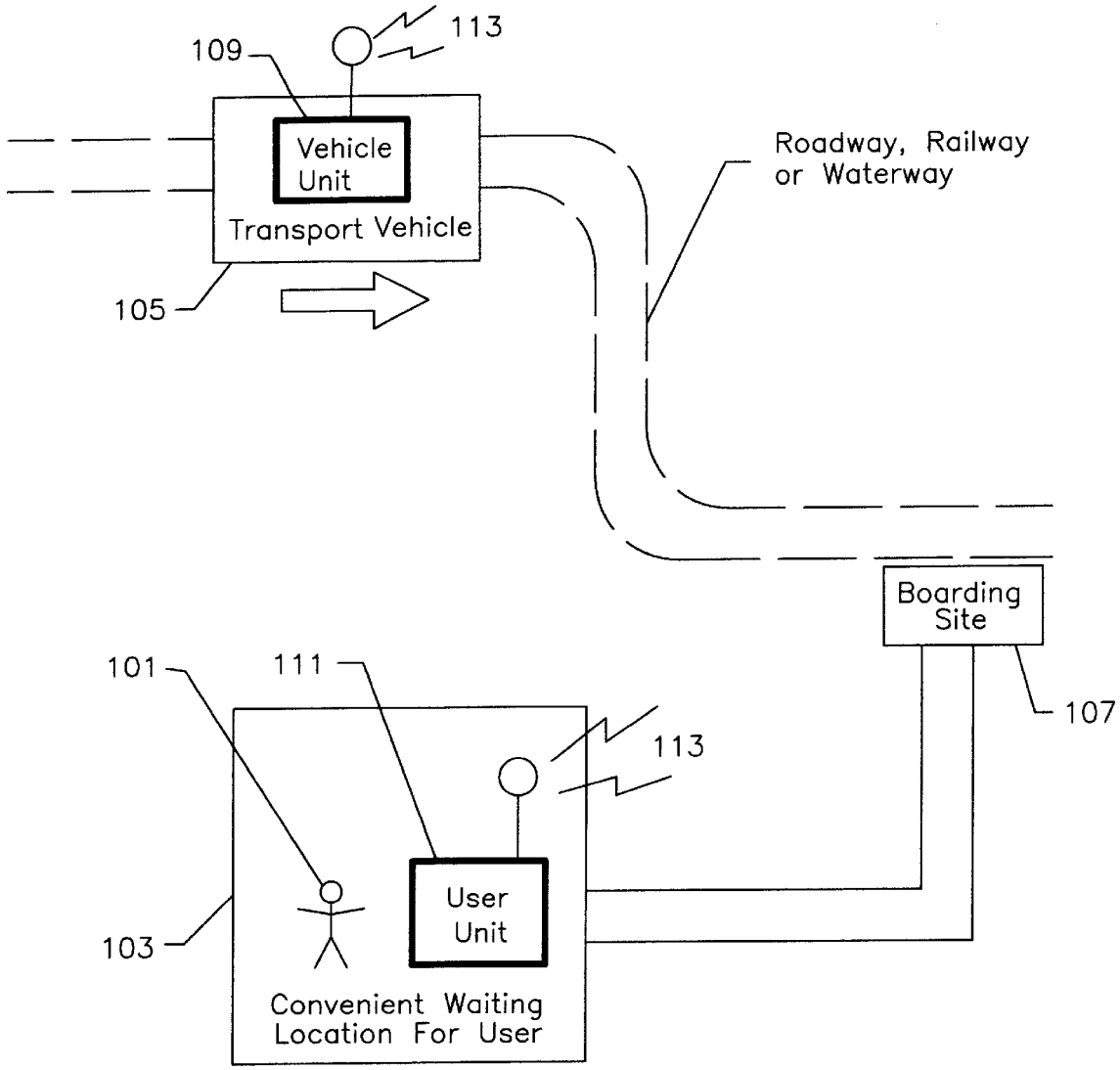
FIG. 1 provides an overview of the autonomous estimator in schematic form.

FIG. 1 illustrates the general use of the autonomous estimator. A user 101 waits at a convenient location 103, such as home or office, for a surface transportation vehicle 105, such as a bus, car, train or boat. Using information transmitted over a radio channel 113 by the vehicle unit 109, the user unit 111 computes and displays the time remaining until the vehicle arrives at the boarding site 107 where the user will board the vehicle. The user is thereby provided with the means for minimizing the time spent at transportation boarding sites.

Figure 2:
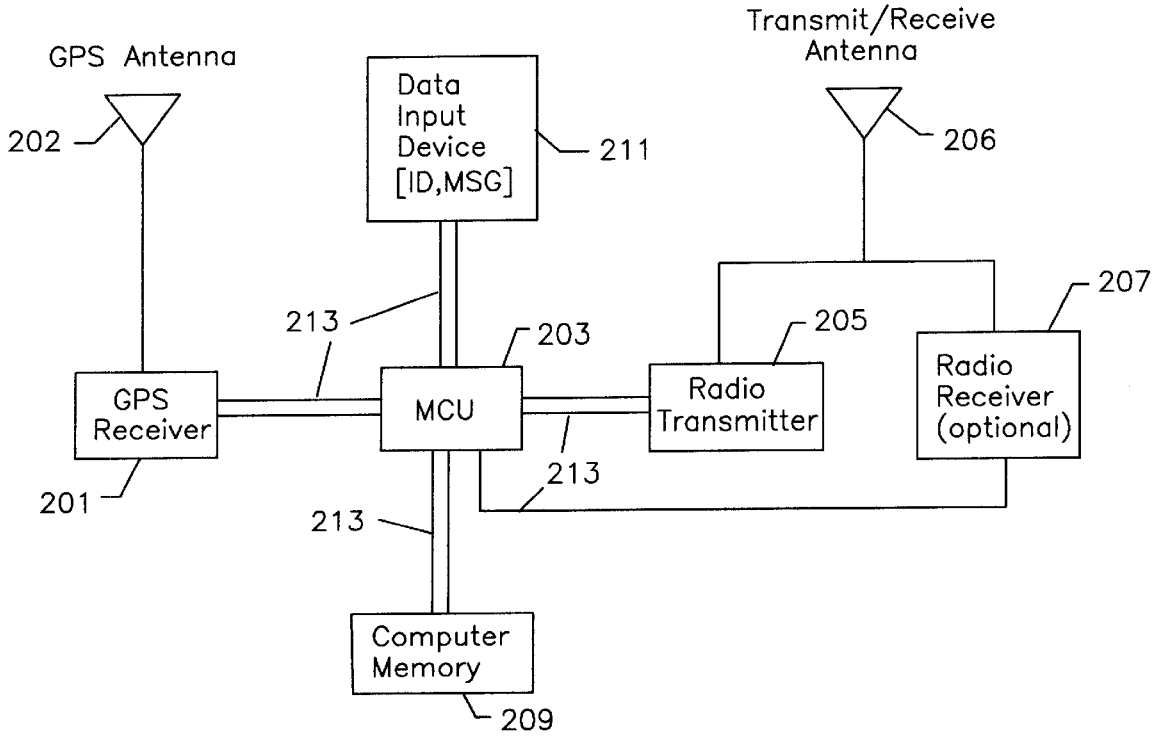
FIG. 2 shows a schematic illustration of the fundamental components of the vehicle unit.

The sole purpose of the vehicle unit 109 is to determine the spatial locations of the transport vehicle at various times T and to transmit that information to the user unit at frequent intervals. FIG. 2 depicts schematically an electronic device that could accomplish this. It is composed of nine basic parts: a global positional satellite (GPS) receiver 201; a GPS receiving antenna 202; a microcontroller unit (MCU) 203; a radio transmitter 205; an optional radio receiver 207; a transmit/receive antenna 206; a computer memory component 209; a data input device 211; and a network of data, address and control lines 213 that connect these components with one another.

The GPS receiver 201 determines time and location using information received over its antenna 202 from a constellation of earth orbiting satellites. A wide variety of GPS receiver and antenna systems are currently available in compact physical forms and at low cost. They can provide time/location data at intervals of about one second. We emphasize that any device available now or in the future that can determine spatial location and time could be used instead of the GPS. Therefore, any apparatus and method as set forth in the application but using such alternatives in place of the GPS is included in the scope of this invention.

The microcontroller 203 executes a computer program that collects time/location data from the GPS unit at predetermined times and records it in the computer memory 209 for subsequent broadcast over radio transmitter 205 and its antenna 206. Communication among the GPS receiver 201, the microcontroller 203, and the radio transmitter 205 is conducted over the data, address and control line network 213.

The data input device 211 would allow the vehicle operator to specify the route/vehicle identification information that would be attached to the time/location data broadcasts.

The same device could also serve as a means of inserting messages into the broadcast, such as "not in service", or to request emergency assistance. In the simplest embodiment, the input device 211 would be eliminated and the required identification information would be inserted into the microcontroller's data base remotely over radio receiver 207.

The vehicle unit depicted in FIG. 2 could be implemented in various physical forms. In one embodiment, the means for determining space-time coordinates of the vehicle unit's location would be a GPS receiver/antenna system, such as Motorola's Oncore GT Plus or a comparable system; and the broadcasting means would be a two-way paging device, such as Motorola's Page Writer 2000, or a comparable device. In this embodiment, the paging device would contain all of the parts shown in FIG. 2 except the GPS receiver 201 and antenna 202 which would reside outside the pager and communicate with it over an external extension of the data network 213. The GPS data collection and broadcast operations would be controlled by a conventional applications program downloaded into the paging device.

Figure 3:
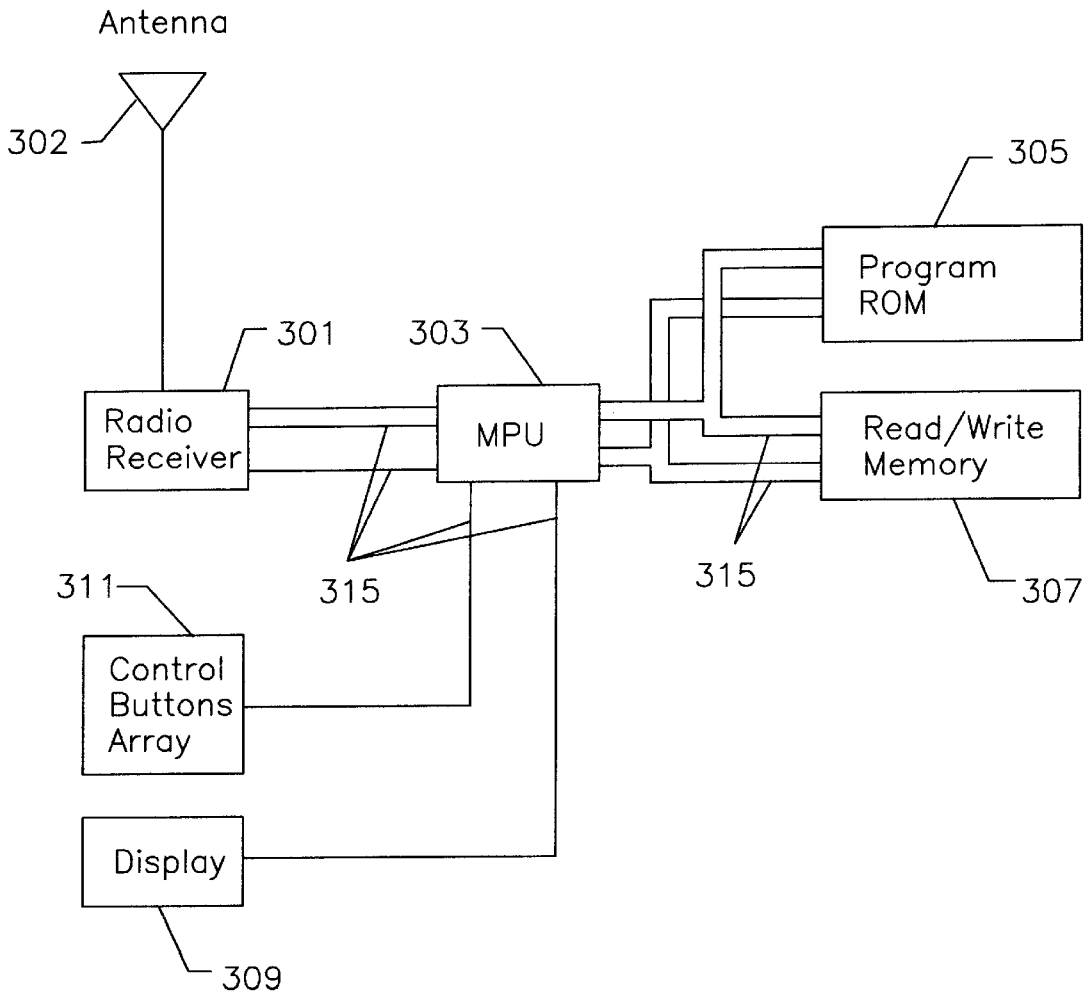
FIG. 3 shows a schematic illustration of the fundamental components of the user unit.

The user unit 111 performs three basic functions: it receives and records the time/location data broadcast by the vehicle unit; it determines the spatial coordinates of the boarding site specified by the user; and it utilizes all this information to estimate the vehicle arrival time. FIG. 3 depicts schematically an electronic device that can perform all these functions. It is composed of eight parts: a radio receiver 301, a radio antenna 302, a microprocessor unit (MPU) 303, a program read-only computer memory (ROM) 305, a read/write computer memory 307, a display 309, a set of control buttons 311, and a network 315 of data, address and control lines.

The user unit depicted in FIG. 3 could be implemented in various physical forms. In the preferred embodiment a modified one-way alphanumeric pager would constitute the user unit. One-way paging devices contain all of the components illustrated in FIG. 3. In this embodiment the three basic functions of the user unit are executed by the pager's microprocessor, using code stored in the pager's read-only memory.

Operation

Figure 4:
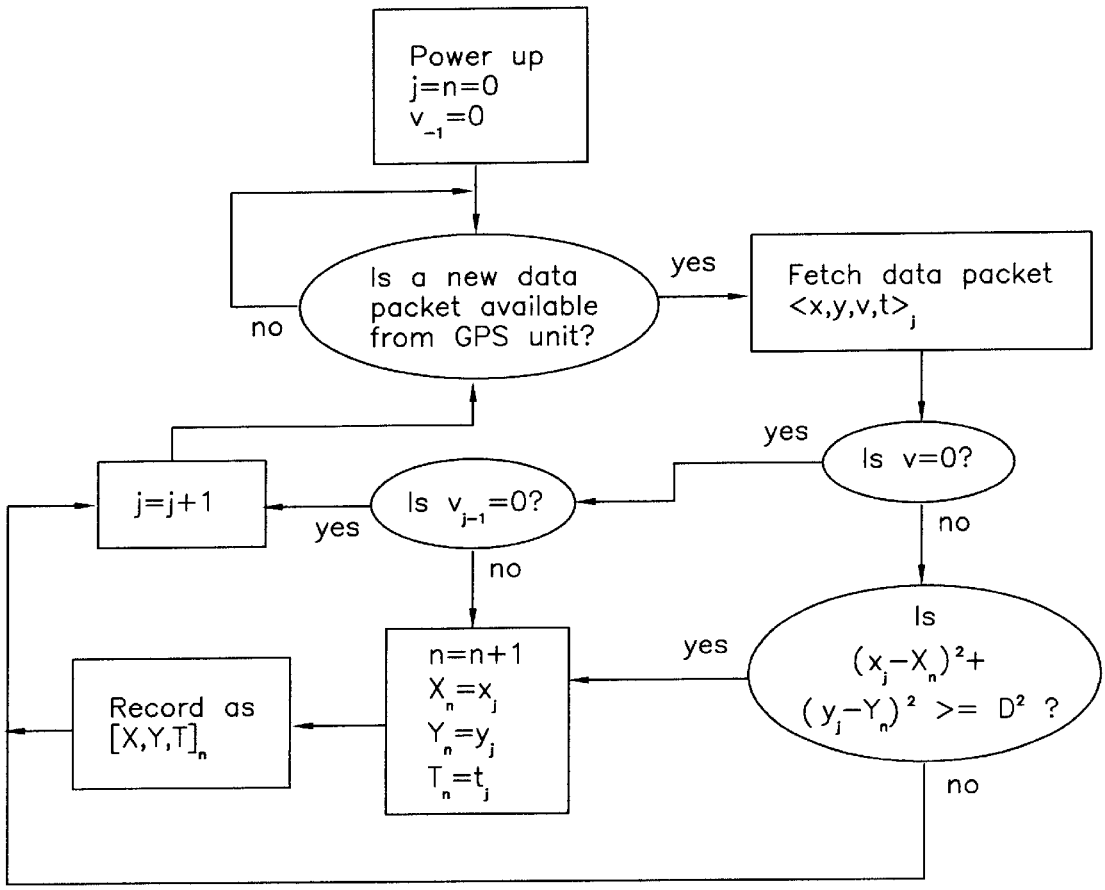
FIG. 4 shows a flow chart of the process used in the vehicle unit to collect space-time coordinates $[X,Y,T]_n$ of the transport vehicle's route.

The GPS receiver 201 which constitutes a principal part of the vehicle unit, as illustrated in FIG. 2, generates data packets consisting of spatial coordinates, velocity, time and other related information at regular intervals of time. Not all of these data packets are needed to perform the vehicle arrival time estimates so it is one task of the microcontroller 203 to collect for broadcast only those data that are needed. Three specific sets of data are required: (1) the spatial coordinates of all places where the vehicle stops, (2) the times at which the vehicle arrived at each of these stops, and (3) space/time coordinates of waypoints between stops that are separated by large distances. The location of the stops are needed because some of these are boarding sites and their spatial coordinates are essential in the arrival time calculations. Likewise, the time of arrival at each stop must be known to determine how long it takes the vehicle to move from point to point along its route. The waypoints between widely separated stops are necessary to allow timely updates of the vehicle arrival time estimates. The microcontroller collects these significant data using the procedure described below and summarized in flow chart form in FIG. 4.

Let $<x,y,v,t>_j$ denote the $j^{th}$ data packet produced by the GPS unit, where x represents the latitude of the vehicle's position, y represents its longitude, v is the vehicle's velocity and t is the time at which x, y, and v apply. The GPS units presently available generate data packets at intervals of about one second. In other words, $t_j - t_{j-1}$=one second. Here and in the discussions that follow we will use the packet subscript j to reference individual elements of the packet, namely, $<x,y,v,t>_j = <x_j,y_j,v_j,t_j>$.

Let j=k be a data packet in the sequence that meets the following condition:

$$v_k=0 \text{ and } v_{k-1}\neq 0 \qquad \text{Eq. 1}$$

This condition occurs each time the vehicle comes to a stop. Hence, $(x_k,y_k)$ are the spatial coordinates of a stop point on the vehicle's route—which may or may not be a boarding site—and $t_k$ is the time that the vehicle reached this point. As we indicated earlier these are data that are required to perform the vehicle arrival time calculations so the microcontroller must collect all packets $<x,y,v,t>_k$ that satisfy condition Eq. 1. Since the velocity v in all such packets is zero, we can reduce these packets to a three-element form which we shall designate by the brackets [ ], namely $$<x,y,0,t_j=[x,y,t]_j$$

Condition Eq. 1 is the test that the microcontroller applies to the GPS data packets to collect two of the three groups of information that are needed to perform the vehicle arrival time estimates, namely the location of all stops and the times of arrival at each stop. The microcontroller applies the following test to collect the third data type, specifically the waypoint space/time locations.

Let j=J denote the last packet produced by the GPS unit and let j=j' denote the last packet that satisfied either condition Eq. 1 or the rule that we are about to define. In other words, j=j' indicates the last packet that has been collected from the GPS data stream. Then if $$(x_J-x_{j'})^2+(y_J-y_{j'})^2 \geqq D^2 \qquad \text{Eq. 2}$$

where J=last generated packet and j'=last collected packet, we form the three-element packet $[x,y,t]_J$ from the elements of $<x,y,v,t>_j$ and we add it to the collected set of data. Here, D is a specified distance that is chosen to achieve a desired temporal resolution in the vehicle arrival time estimates. For example, if a one minute resolution is desired, then D should be the average distance that the vehicle moves in one minute as it travels between stops.

In essence, the microcontroller uses conditions Eq. 1 and Eq. 2 to eliminate unessential packets from the data stream generated by the GPS unit. (Refer to FIG. 4 for a summary of this process.) The data that are kept are retained as three-element packets which we will denote by [X,Y,T], each of which is the space-time coordinates of a point on the vehicle's route. Each of these packets must be broadcast to the user units where they will be recorded and used in the vehicle arrival time calculation. We use the capital letters X, Y, and T to distinguish the space and time data that will be broadcast from the general stream of space and time data, designated by x, y, and t, generated by the GPS unit.

The [X,Y,T] data can be broadcast either individually as they are generated, or they can be recorded temporarily in the vehicle unit's memory and broadcast in groups at less frequent intervals. The latter method permits more efficient use of the radio channel for two reasons.

First, in most areas more than one transport vehicle is operating in a given region at any time. Consequently, the [X,Y,T] transmission must be tagged to enable the user unit to determine the vehicle to which the data apply. Attaching a tag to each [X,Y,T] would clearly require a greater volume of data transmission than attaching one tag to a group of [X,Y,T] data.

Secondly, by transmitting multiple [X,Y,T] packets in a single broadcast, we can make use of data compression techniques to reduce the broadcast load still further. To illustrate, suppose that we transmit five packets $[X,Y,T]_1, \ldots, [X,Y,T]_5$ as a group. We could express the elements of the first packet in their full precision, say, 4 bytes for each of the three elements. However, rather than sending the second packet in its full precision form, we could transmit the difference $$[(X_1-X_2), (Y_1-Y_2), (T_1-T_2)]$$

because each of its elements is inherently a small number that can likely be described by a single byte. Similarly, we could broadcast the difference between $[X,Y,T]_3$ and $[X,Y,T]_2$, and so on. Other compression methods could also be applied.

The optimum number of packets that are put in a broadcast group is determined by a number of factors. One of these is the cost of using the radio channel. The preferred embodiment utilizes the radio paging infrastructure as the communications medium wherein the vehicle unit transmits its data by executing a two-way group page, the group being the users of that vehicle who subscribe to the information service. Some paging service providers currently use a cost algorithm that bases price on units of ten broadcast bytes. In this case optimum cost would be realized by using a packet group size that would compress to a multiple of 10 bytes.

Having described the operation of the vehicle unit, we turn now to the user unit described schematically in FIG. 3. The radio receiver 301 receives the [X,Y,T] data broadcast by vehicles operating in the area. We noted earlier that each such broadcast contains information that identifies the route and vehicle to which the data pertain. This information could be provided in a number of ways, depending on the way in which the system is implemented, but in any event it is a straightforward task to build into the receiver component of the user unit the capability of collecting data only for specific routes and vehicles. For example, in one embodiment the receiving means is a one-way radio paging device. Most such devices now available can be programmed to receive messages only from specific sources.

We begin the description of the operation of the user unit by emphasizing that the unit performs three basic tasks:

(1) It records the space-time description of the transport route—we may think of this as "learning" the route;

(2) It determines the spatial coordinates of the site where the user wishes to board the vehicle;

(3) It estimates the time of arrival of the transport vehicle on all its traversals of the route once the boarding site has been defined.

Figure 5A:
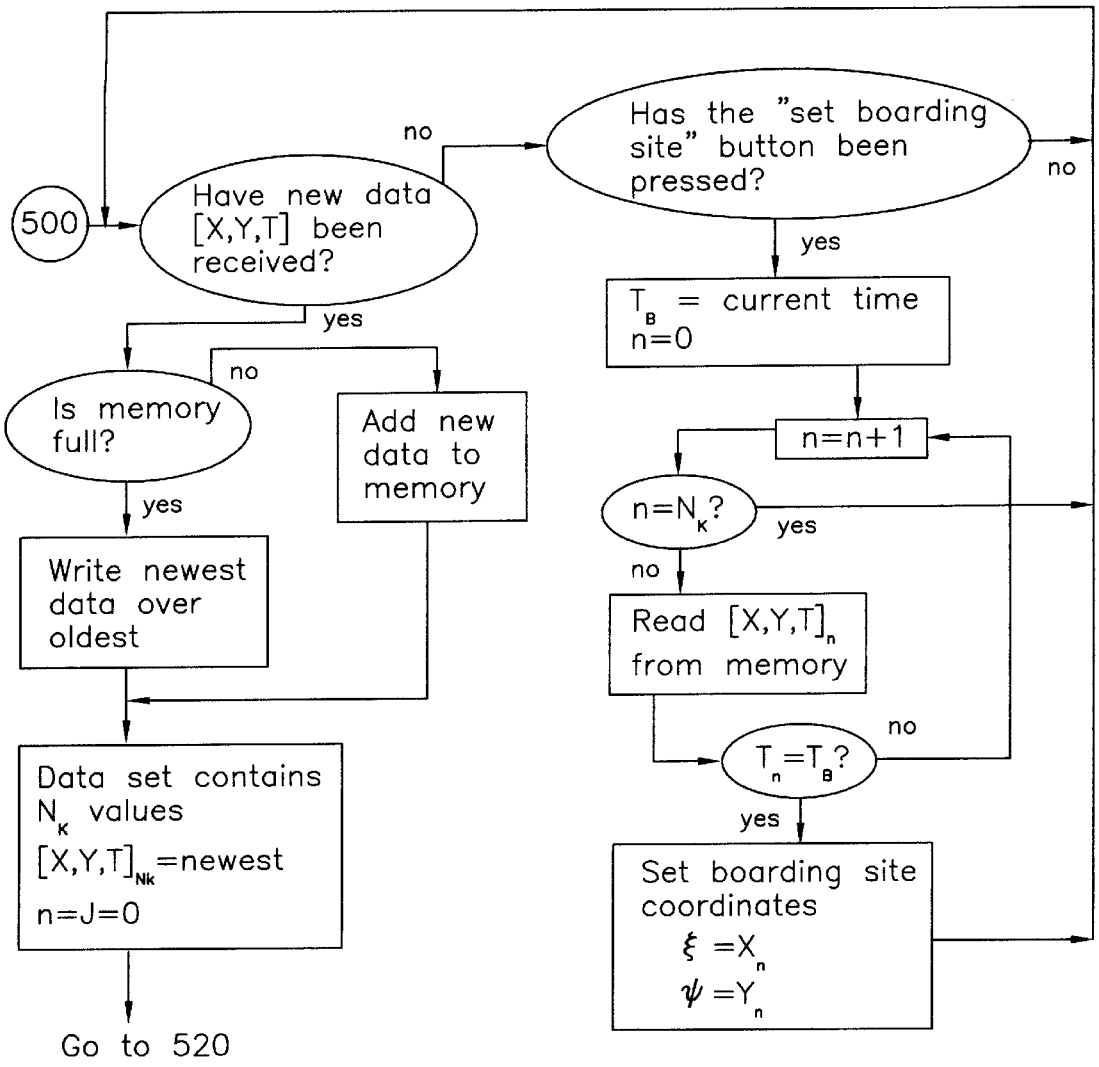
FIGS. 5A,B,C show a flow chart of the operations performed in the user unit.
Figure 5B:
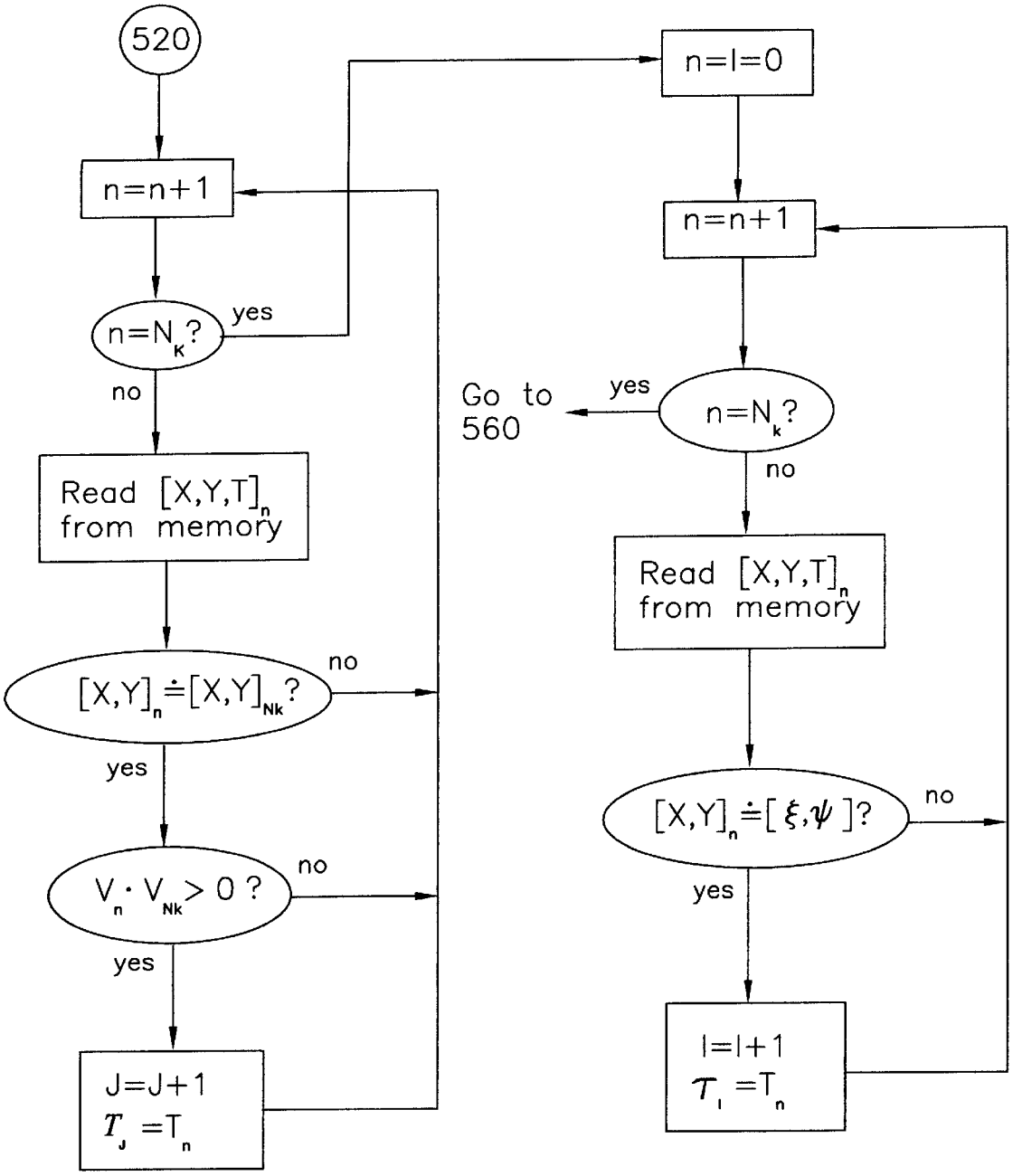
Figure 5C:
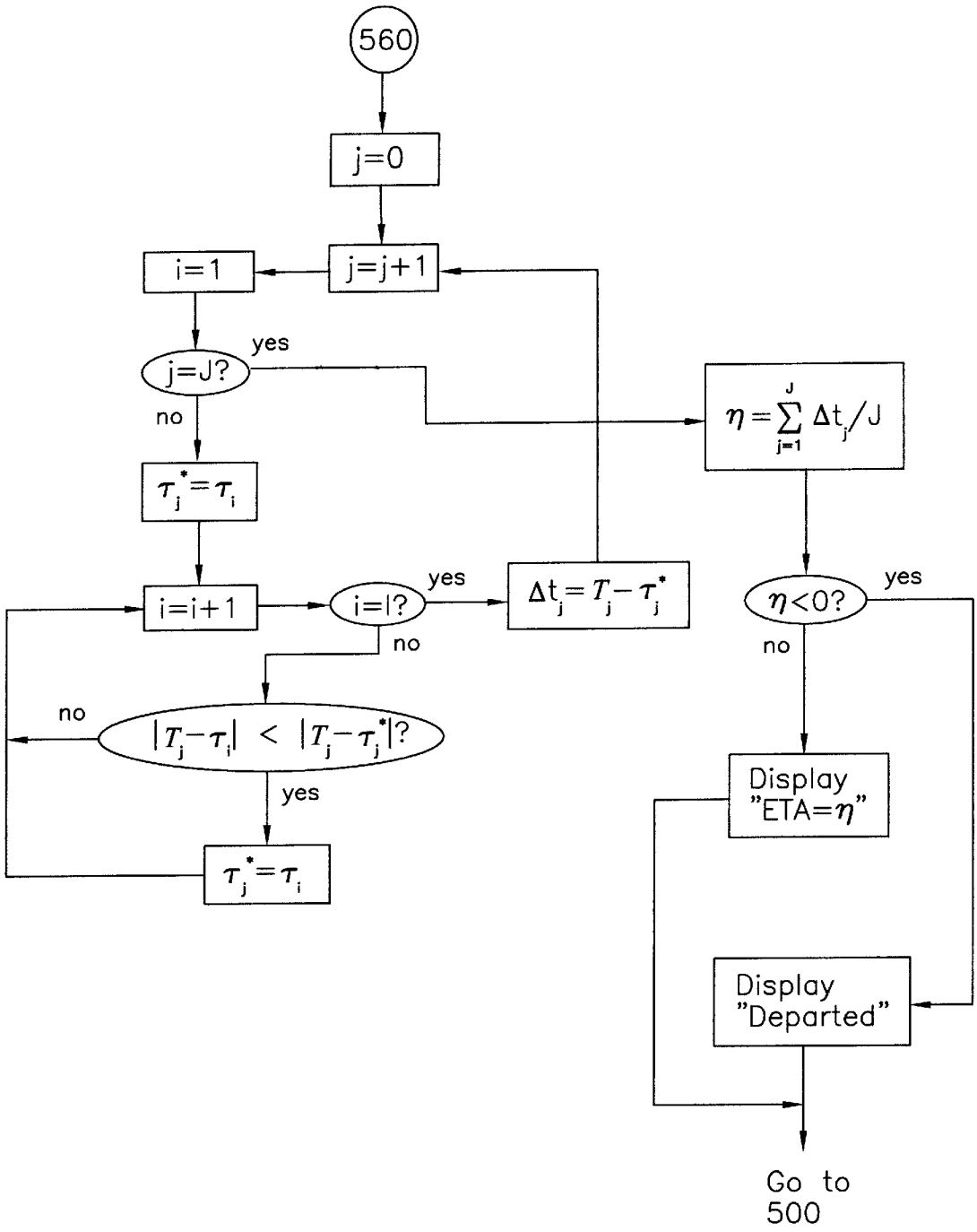

A fourth task that the user unit could perform would be to provide important information relevant to the transportation service. In the case of the school bus this information could include notices of school closings, late starts, and so on. The steps performed by the user unit are summarized in flow chart form in FIGS. 5A,B,C. When a user unit is first placed in service its microprocessor 303, see FIG. 3, will have been programmed to collect data for a specific route (or routes in the general case). All data received from vehicles operating on that route are recorded in the read/write memory 307. (In the general situation where multiple vehicles operate on the same route, the data collected from each vehicle would be stored in a separate area of memory to facilitate the subsequent arrival time calculations.) After the user unit has been in operation for several days, it will have recorded data from a number of different traversals of the route. On average, half of these traversals will have been in the "inbound" direction and half in the "outbound" direction. If data from multiple traversals have in fact been recorded, the data records will contain multiple instances of space-time coordinates [X,Y,T] with the same spatial component [X,Y]. (Keep in mind that the coordinates of all points where the vehicle stops are transmitted.) This fact provides a means of restricting the data set to a size that is practical yet sufficient for the intended needs, as we now describe.

Suppose that after the user unit has first been activated and has been writing data continuously to memory for some time, a total of N space-time coordinates $$[X,Y,T]_n \quad n=1, \ldots, N \qquad \text{Eq. 3}$$

have been recorded. Since these data are generated, received and recorded in chronological order, they possess the following properties:

$$[X,Y,T]_N = \text{current vehicle location}, \qquad \text{Eq. 4a}$$

$$T_n > T_{n-1}, \text{ all n.} \qquad \text{Eq. 4b}$$

We say that the database defined by Eq. 3 contains redundancy if at least two of its members have the same spatial component [X,Y]. In particular we make the following definition:

The space-time coordinate database defined by Eq. 3 is K-fold redundant if there exists K numbers n1, n2, . . . , nK, no two of which are equal and all lying in the interval 1 to N, inclusively, such that $$[X,Y]_{n1} \doteq [X,Y]_{n2} \doteq \ldots \doteq [X,Y]_{nK}. \qquad \text{Eq. 5}$$

Here and in the discussions that follow we use the symbol to indicate equivalence to the extent that the quantities are measurable. In the case of spatial position measured by the GPS, accuracy is of the order of 50 meters.

The degree of redundancy increases with time (and hence N) as new traversals of the route are made in the same direction or traversals in the opposite direction occur. From this knowledge we reason that the database defined by Eq. 3 cannot contain at least one full description of the route until N is large enough that the database is 3-fold redundant—2-fold redundancy could be caused by two separate vehicles traversing the same subportion of the route in opposite directions. Consequently, if we desire only one description of the route, which is the minimum necessary to make arrival time estimates anywhere on it, we allow the database to grow until it satisfies the criterion defined by Eq. 5 for 3-fold redundancy, and at that point, say N=N3, we terminate the expansion of the database in memory. The next data point that is received, namely $[X,Y,T]_{N3+1}$, is written into the memory slot occupied by $[X,Y,T]_1$; $[X,Y,T]_{N3+2}$ is written into the memory slot occupied by $[X,Y,T]_2$; and so on. This is the circular buffering technique in which the newest data overwrites the oldest and the memory size is constant. In this case the memory would have to be large enough to hold N3 space-time coordinate values [X,Y,T] and it would always contain the N3 most recent samples.

While 3-fold redundancy is adequate to make arrival time estimates it is not sufficient to make refined predictions. Having data from multiple traversals of the route provides information on the magnitude of inherent fluctuations in travel speed and this in turn permits the arrival time estimate to be expressed in terms of a most probable arrival time rather than a simple ad hoc estimate. Moreover, in some areas traffic may always be better or worse on some days of the week than others and having data from traversals throughout a week would allow the arrival time estimate to take this into account. Thus, we are led to the conclusion that the space-time database should be allowed to grow as large as the available memory will permit. Accordingly, we will assume from here on that the database is K-fold redundant and will represent it by $$[X,Y,T]_n \quad n=1, 2, \ldots, N_K \qquad \text{Eq. 6}$$

wherein $n=N_K$ is the most recently received data, which is also the current vehicle position in accordance with Eq. 4a; and n=1 represents the oldest data.

Having described the data recording process we turn next to the specification of the user's boarding site. One of the novel features of this invention is that it allows the user to identify his or her desired boarding location simply by pressing a button on the user unit. In the preferred embodiment the user unit is essentially a one-way alphanumeric pocket pager containing a button device labeled "set boarding site". When the transport vehicle is stopped at the desired boarding location, the user presses the button device and all subsequent arrival time estimates displayed on the user unit pertain to arrivals at this site. Since the user unit can be made portable and very compact, it could be carried about by the user and the boarding site reset as often as desired. For example, after using the user unit to learn the arrival time of the transportation vehicle at his home site, the user could carry it and reset the boarding site to the deboard point in order to get arrival time estimates for the return trip. This capability of the invention provides the utmost in ease of operation and flexibility of use. In addition, it precludes the need for a central database of bus stop locations, geographical coordinate data, or the like that might otherwise be necessary to specify each user's boarding location. This invention is a truly autonomous means of providing essential information to the users of transportation facilities or any other application where the location of route-following vehicles is useful information.

The process that accomplishes the boarding site specification task is the following. When the "set boarding site" button device, which is a component of button array 311 is pressed, the microprocessor component 303 of the user unit, see FIG. 3, accesses an internal time source to determine the time $T_B$, say, that the button device was pressed. Then the microprocessor searches the data base defined by Eq. 6 looking for a space-time coordinate [X,Y,T] whose time component $T \doteq T_B$. If it is not found in the data base at the time of the button press it will be found in the next batch of data received from the transport vehicle because, it will be recalled, its vehicle unit broadcasts the space-time coordinates of all points where the vehicle stops. If $[X,Y,T]_\beta$ is the coordinate whose time component $T_\beta$ is equal to the time $T_B$ of the button device press, then $[X,Y]_\beta$ is the spatial location of the vehicle at the time of the press, which is the chosen boarding site. Hence, if we use the special symbols $[\xi,\psi]$ to denote the boarding site coordinates, we have $$\xi=X_\beta, \ \psi=Y_\beta \qquad \text{Eq. 7}$$

where $X_\beta$ and $Y_\beta$ are the spatial components of the data element $n=\beta$ in the set defined by Eq. 6 whose time component $T_\beta=T_B$.

Knowing the boarding location we can now proceed to the final task of estimating the time of arrival of transport vehicles to this site. Vehicles can approach the boarding location from either the inbound or outbound direction, so we need a means of discriminating between travel direction in our manipulation of the database defined by Eq. 6. We can accomplish this using the velocity vector $V_n$ defined as follows:

$$V_n=[(X_n-X_{n-1}), (Y_n-Y_{n-1})], \ n=1, \ldots, N_K \qquad \text{Eq. 8}$$

If n1 and n2 are two elements of the database defined by Eq. 6 that have the same spatial location, namely $$[X,Y]_{n1} \doteq [X,Y]_{n2},$$

then the vehicle that was here at time $T_{n1}$ was moving in the same direction as the one that was here at $T_{n2}$ provided that the dot product of the vector $V_{n1}$ and $V_{n2}$ is greater than zero. If the dot product is negative, the travel directions were opposite (recall Eq. 4b). We define the dot product in the conventional way, namely $$V_1 \cdot V_2 = v_{x1}v_{x2}+v_{y1}v_{y2} \qquad \text{Eq. 9}$$

where $V=[v_x, v_y]$.

The arrival time calculation begins with the current vehicle location $[X, Y, T]N_K$, and velocity $V_{NK}$ (see Eq. 4a and Eq. 8, respectively). If the user unit were receiving data from more than one vehicle operating on the route at the same time, it would estimate an arrival time for each of them separately. For each vehicle, the procedure is as follows (see FIGS. 5A, B, C for an overview).

First we scan the database defined by Eq. 6 and identify all members whose spatial component is equivalent to the current vehicle location $[X, Y]_{NK}$. That is $$[X, Y]_{nj} \doteq [X, Y]_{NK}, \ j=1, \ldots, J' \qquad \text{Eq. 10}$$

Since the database defined by Eq. 6 is K-fold redundant we would expect to find at most K such points, or $J' \leqq K$.

Next, we form the dot product of $V_{NK}$ with the velocity vector $V_{nj}$, j=1, . . . , J' corresponding to each of these points and we discard all points for which the dot product is negative. The purpose of this step is to select from the database defined by Eq. 6 only those data that were obtained when a transport vehicle was at the same location and traveling in the same direction as the one currently being monitored. This step will eliminate about one-half of the J' points if the database defined by Eq. 6 is composed of equal numbers of inbound and outbound route traversals. From each of the retained $[X, Y, T]_{nj}$ we extract the time component and form the sequence $$T_j, \ j=1, \ldots, J \quad J \leqq K/2 \qquad \text{Eq. 11}$$

Briefly stated, these times are taken from the members $[X, Y, T]_n$ of the database defined by Eq. 6 whose spatial components $[X, Y]_n \doteq [X, Y]_{NK}$ and whose velocity vectors satisfy $V_n \cdot V_{NK} > 0$.

Next we scan the database defined by Eq. 6 and identify all members whose spatial component is equivalent to the boarding site $[\xi, \psi]$. That is $$[X, Y]_{ni} \doteq [\xi, \omega] \ i=1, \ldots, I \qquad \text{Eq. 12}$$

and from the time components of these members we form the sequence $$\tau_i, \ i=1, \ldots I. \qquad \text{Eq. 13}$$

By earlier reasoning we expect $I \leqq K$ . Briefly stated, the sequence defined by Eq. 13 is the set of all previous times that a transport vehicle was at the boarding location.

Reasoning from the definitions of T and $\tau$ we arrive at the set of J previously observed times of travel between the vehicle's current location and the boarding site taking into account the vehicle's current direction of travel, namely $$\Delta t_j = T_j - \tau_j^* \quad j=1, \ldots J \qquad \text{Eq. 14}$$

where $\tau_j^*$ is the member of the database defined by Eq. 13 for which $|T_j - \tau_i|$ is a minimum. It is this set of times that forms the basis of the arrival time calculations.

The simplest estimate of the arrival time is the average of the $\Delta t_j$ defined by Eq. 14, namely $$\eta = 1/J \, \Sigma_{j=1 \ldots J} (\Delta t_j) \qquad \text{Eq. 15}$$

=expected time remaining until arrival.

If $\eta$ is negative, the vehicle in question has already passed the boarding site—it went by about $|\eta|$ time units ago. Otherwise, the user can expect a wait of $\eta$ time units until the vehicle arrives at his or her boarding site.

If multiple vehicles are operating simultaneously, the user unit would compute $\eta$ for each and display all of the possibilities. Furthermore, the microprocessor within the user unit could be programmed to perform more sophisticated statistical processing of the database defined by Eq. 6 to generate more refined arrival time predictions.

Other modifications of the present invention will readily be apparent to those of ordinary skill in the art from the teachings presented in the foregoing description and drawings. It is therefore to be understood that the invention is not to be limited thereto and that said modifications are to be included within the scope of the appended claims.

What is claimed is:

1. A system for estimating the time of arrival at user selected sites of a vehicle that repeatedly traverses a specific route, comprising:

(a) a vehicle unit which is carried by the vehicle, and (b) a user unit which is available to each user, said vehicle unit comprising means for determining the space-time coordinates of the vehicle at each point where it comes to a stop and at predetermined intervals between stops;

means for broadcasting said space-time coordinates;

said user unit comprising means for receiving said space-time coordinates broadcast by said vehicle unit;

means for generating a database of space-time coordinates, said database containing all space-time coordinates received from said vehicle unit during a plurality of the most recent traversals of the vehicle's route;

button means that the user can press on any one occasion when the vehicle is stopped at a selected site;

means for determining the time $T_b$ that said button means is pressed;

means for finding within said database of space-time coordinates the space-time coordinate S,T whose time component T is equivalent to $T_b$;

means for designating the space component S of said space-time coordinate S,T as the spatial coordinates of said selected site;

means for estimating from the space-time coordinates in said database of space-time coordinates and the space-time coordinates most recently received from said vehicle unit the time of arrival of the vehicle at said selected site;

means for displaying said time of arrival.

2. The system of claim 1 in which said user unit further comprises means for receiving warnings issued by the emergency broadcast system for a specified geographical area;

means for determining whether the spatial coordinates of said selected site are within said specified geographical area;

means for generating an alarm if the spatial coordinates of said selected site are determined to lie within said specified geographical area.

3. A method for estimating the time of arrival at user selected sites of a vehicle that repeatedly traverses a specific route, comprising:

(a) providing a vehicle unit which is carried by the vehicle, and (b) providing a user unit which is available to each user, said vehicle unit automatically determining the space-time coordinates of the vehicle at each point where it comes to automatically a stop and at predetermined intervals between stops;

broadcasting said space-time coordinates;

said user unit receiving said space-time coordinates broadcast by said vehicle unit;

generating a database of space-time coordinates, said database containing all space-time coordinates received from said vehicle unit during a plurality of the most recent traversals of the vehicle's route;

noting the time $T_b$ on any one occasion when the vehicle is stopped at a selected site;

finding within said database of space-time coordinates the space-time coordinate S,T whose time component T is equivalent to $T_b$;

designating the space component S of said space-time coordinate S,T as the spatial coordinates of said selected site;

estimating from the space-time coordinates in said database of space-time coordinates and the space-time coordinates most recently received from said vehicle unit the time of arrival of the vehicle at said selected site;

displaying said time of arrival.

* * * * *